United States Patent [19]

Snow

[11] 4,318,792

[45] Mar. 9, 1982

[54] PROCESS FOR DEPOSITING FORGING LUBRICANT ON TITANIUM WORKPIECE

[75] Inventor: Jerry D. Snow, Parma, Ohio

[73] Assignee: TRW Inc., Cleveland, Ohio

[21] Appl. No.: 165,848

[22] Filed: Jul. 7, 1980

[51] Int. Cl.[3] ..... C25D 13/02; C25D 13/06; C10M 3/04

[52] U.S. Cl. ..... 204/181 R; 204/181 N; 204/181 T; 252/49.3; 252/49.5

[58] Field of Search ..... 204/181 N, 181 T, 181 R; 252/49.3, 49.5

[56] References Cited

U.S. PATENT DOCUMENTS

| | | | |
|---|---|---|---|
| 2,321,439 | 6/1943 | Verwey et al. | 204/37 |
| 3,484,357 | 12/1969 | Plankenhorn | 204/181 N |
| 3,497,376 | 2/1970 | Wieser | 204/181 N |
| 3,582,481 | 6/1971 | Hovey et al. | 204/181 T |
| 3,629,086 | 12/1971 | Brewer et al. | 204/181 R |
| 3,787,338 | 1/1974 | Skelly et al. | 204/181 R |

*Primary Examiner*—Howard S. Williams
*Attorney, Agent, or Firm*—Yount & Tarolli

[57] ABSTRACT

Disclosed is a coating bath and process for electrophoretically depositing a forging lubricant precoat on the surface of a titanium workpiece. The specific resistivity of the coating bath is in excess of about 400 ohm-centimeters in order to retard simultanoues anodization of the titanium during the electrophoretic deposition process. A high lead, moderate silicate, low alkali metal oxide frit is used in suspension in the bath. Advantageously, the bath also includes an anodic electrocoating resin in colloidal dispersion in the bath. By controlling the degree of anodization and preanodization of the titanium, thickness of the deposited forging lubricant precoat can be closely controlled.

19 Claims, 2 Drawing Figures

PROCESS FOR DEPOSITING FORGING LUBRICANT ON TITANIUM WORKPIECE

BACKGROUND OF THE INVENTION

This invention relates to the art of titanium forging and more specifically to a process for electrophoretically depositing components of a vitreous forging lubricant precoat on the surface of titanium and/or titanium alloy workpieces. Additionally, the invention relates to the control of the thickness of the forging lubricant precoat over the surface of the workpiece. The process of the invention is also useful in identifying defects in the surface of the workpieces which might otherwise go unnoticed.

Vitreous or glass-like forging lubricants for titanium alloys are known. Commonly, the forging lubricant is provided on the titanium workpiece by initially dipping, spraying, or painting a suspension of lubricant components as a precoat on the surface of the workpiece. At forging temperatures, the precoat becomes a molten glass having the approximate viscosity of bottled honey (about 40 PaS). The fused glass provides a thick film, hydrodynamic lubricant to facilitate the flow of the titanium. Glasses primarily comprised of borates, high-alkali silicates and borosilicates and phosphates have found commercial acceptance.

Vitreous coating formulations generally comprise one or more glass frits in a finely divided state suspended in an organic fluid such as isopropanol. Suspension aides such as clay and inert fillers are also typical of these compositions. Workpieces are generally coated by dipping, spraying or painting the suspension on the workpiece. In order to build up sufficient coating thickness, several applications are often necessary. Control of the thickness of the lubricant precoat over the surface of the workpiece is difficult using dipping, spraying or painting methods. Thickness control is essential in order that an acceptable surface finish may be provided on precision forgings. Specifically, gravity and often complex workpiece geometry work together to cause a thick coating to be developed in some portions of the workpiece, while other portions have only very thin coatings. Uneven coating may result in mottled or rippled portions on the final forged surface of the workpiece. If the coating is too thin, there may be localized contact between the forging die and the workpiece. Diffusion bonding and die wash may result.

In addition to the problems of uneven precoat thickness using the known methods for applying forging lubricant compositions, "green" (unfired) strength of such coatings is also inadequate. Specifically, titanium workpieces are often subject to considerable handling prior to forging which may result in the coating being chipped off or scored if the "green" strength is too low.

Electrophoretic processes have been suggested for applying the lubricant precoat. Such have been suggested because electrophoretic processes are known to result in uniform coating thickness. The process of electrophoresis involves the movement and deposition of discrete charged particles in a fluid suspension. Negatively charged particles are deposited on a positive electrode (anode) while positively charged particles are moved to and discharged or deposited on a negative electrode (cathode). Electrophoretic processes may be carried out in an aqueous or a solvent-based system.

Electrophoretic processes are used to deposit both organic and inorganic films on an appropriate electrode.

A latex glove may be deposited by electrophoretic deposition of the latex from an emulsion onto an anodically charged metal form. Electropainting is an important electrophoretic process used for producing paint coatings on metal articles such as toys, furniture, bicycles, etc. Electrophoresis is particularly useful in coating automobile bodies due to its ability to relatively evenly coat interior and exterior surfaces as well as recesses and occluded areas.

Electrophoresis has long been used in inorganic processes such as the purifying of clay. Charged clay particles are easily separated from the overburden by the application of an electrical potential to a water suspension of a raw clay. More recently, electrophoresis has been used in the deposition of porcelain enamels on steel bodies for appliances. Since these coated articles are not normally handled to any great degree between the coating and the firing of the enamel, the fact that the coatings have minimal adhesion or green strength following the electrophoretic coating process presents little problem. U.S. Pat. No. 3,484,357 is illustrative of electrophoretic coating processes to deposit a porcelain enamel on steel.

Glass coatings have also been commercially applied by electrophoretic deposition for the manufacture of substrates for electronic circuitry. Again, low green strength properties do not present a substantial disadvantage. A similar process for depositing a vitreous insulation on wire for forming a dielectric layer on electrical condensers, resistor units, etc. as well as the enameling of cooking utensils is disclosed in U.S. Pat. No. 2,321,439.

Prior attempts to utilize these beneficial electrophoretic coating processes to deposit glass lubricant components on a titanium forging preform such as for a turbine fan blade have met with failure. A titanium alloy workpiece is quickly anodized to form titanium oxides on the surface when charged as an anode in typical electrophoretic coating solutions. An electrically insulating layer of titanium dioxide ($TiO_2$) is quickly formed on the surface of the titanium workpiece. Such a high resistance layer reduces or essentially eliminates any possibility of electrophoretic deposition of a coating onto the surface of a titanium workpiece since the applied voltage is almost entirely lost to the high resistance coating of $TiO_2$. Thus, electrophoretic processes which have worked well for deposition of glass layers on steel or other conductive substrates have not been capable of use for applying a glass layer to a titanium alloy substrate.

It is necessary, and often critical, that defects in a titanium workpiece be identified before the final product is released for use. Defects such as forging laps, cracks, crevices, compositional inhomogeneities, etc., often go undetected in the early stages of forging and are sometimes completely obscured by later forging steps. Inspection at the end of the forging process is often incapable of detecting these obscured defects which could result in the in-service failure of a forged article. In some applications, such failure could have disasterous consequences.

In an effort to avoid failure of a forged article in use due to an undetected defect, inspection at various forging stages is necessary. Thus, particularly in critical applications, a workpiece is inspected at several points in the forging operation. Sonic inspection or the socalled "blue etch anodize" inspection or a combination of both are common.

In the "blue etch anodize" process, the titanium workpiece is anodized to an overall blue color. Defects such as forging laps, cracks, crevices, etc., show up as an amber or a reddish purple area in the otherwise blue surface. Defective parts are, thus, detected and removed from further processing. For critical applications, each part must be so inspected after each stage in the forging process. Obviously, such multi-step individual handling and inspection greatly increases the cost of the final article.

SUMMARY OF THE INVENTION

The present invention provides a forging lubricant coating bath and a process which overcomes prior difficulties in electrophoretically depositing a lubricant coating onto the surface of a titanium workpiece. In fact, surprisingly, the controlled production of an anodize layer on the surface of a titanium workpiece is used to advantage to control the thickness of an electrophoretically deposited coating from the bath and by the process of this invention. The invention also provides a defect detection process which does not involve additional processing steps and eliminates, to a substantial degree, prior defect detection costs.

In accordance with the invention, the titanium workpiece is precoated with components of a vitreous forging lubricant by immersing the workpiece in an electrophoretic coating bath having a specific resistivity in excess of about 400 ohm-centimeters. The coating bath generally comprises a suspension of particulate forging lubricant components and, optionally, may include an organic resin in solution in the bath. The titanium workpiece is connected as an anode and a cathode is provided in contact with the coating bath. Upon application of direct current, forging lubricant components are deposited on the surface of the workpiece.

The thickness of the coating applied through the aforementioned process may be controlled by at least partially preanodizing portions of the surface of the titanium workpiece prior to immersion in the coating bath. The thickness of the electrophoretically deposited coating is inversely proportional to the degree of preanodization. That is, the greater the degree of preanodization, the thinner will be the resultant coating when an electrophoretic deposit is applied. Thus, a titanium workpiece is provided in contact with an anodizing electrolyte. A cathode for the anodizing process is also provided in contact with the anodizing electrolyte. By controlling the applied voltage and cathode position relative to the workpiece, the workpiece may be selectively preanodized over its surface. The workpiece may then be processed as above described to electrophoretically deposit a forging lubricant precoat.

Further in accordance with the invention, a novel titanium forging lubricant bath composition capable of being deposited on titanium workpieces by electrophoretic processes is provided. The bath composition includes one or more frit components in suspension in the bath, the frit having an unusually low alkali metal content (compared to normal forging lubricants) to improve leaching resistance. A level of $B_2O_3$ is balanced to provide a low viscosity for the melted lubricant while not increasing leachability in suspension. A balanced level of alkaline earth metal oxides and/or zirconium dioxide is provided to further improve leach resistance in suspension. Finally, a moderately high lead oxide content and a moderate silicon dioxide level are provided to yield a stable glass and produce a viscous melt. The composition generally comprises 33%–73% PbO, 0%–12% $B_2O_3$, 20%–38% $SiO_2$, 0%–8% $ZrO_2$ and alkaline earth metal oxides, all percentages being based on weight of the dry components of the coating composition.

In a preferred embodiment of the invention, the above-mentioned bath composition further includes an organic resin binder in aqueous colloidal dispersion with the suspended frit. This has been found to increase the "green" strength of the lubricant precoat.

Still further in accordance with the invention, defects in a titanium workpiece are detected by a process comprising the steps of electrophoretically depositing a forging lubricant precoat on the surface of the titanium workpiece as described above, followed by the step of visually inspecting the thus coated workpiece for areas of increased coating thickness, such increased coating thickness serving to indicate a defect in the workpiece.

From the above it should be apparent that an object of this invention is to provide a coating bath composition and method for electrophoretically precoating titanium alloy workpieces with a forging lubricant precoat.

Moreover, another object of this invention is to provide a process for controlling the thickness of an electrophoretically deposited forging lubricant precoat by selectively preanodizing portions of the surface of a titanium workpiece prior to electrophoretically depositing a forging lubricant precoat.

It is another object of this invention to provide a forging lubricant coating for titanium alloy workpieces which has good green strength to avoid damage to the coating during handling prior to fusion at high temperatures.

It is yet another object of this invention to provide a simple process for detection of defects in a titanium workpiece.

BRIEF DESCRIPTION OF THE DRAWINGS

The above and other objects and features of the present invention will become apparent to those skilled in the art upon consideration of this specification in conjunction with the accompanying drawings forming a part of the specification and illustrating a preferred embodiment of the invention and in which.

DETAILED DESCRIPTION OF ONE PREFERRED EMBODIMENT OF THE INVENTION AND THE DRAWINGS

Figure 1:
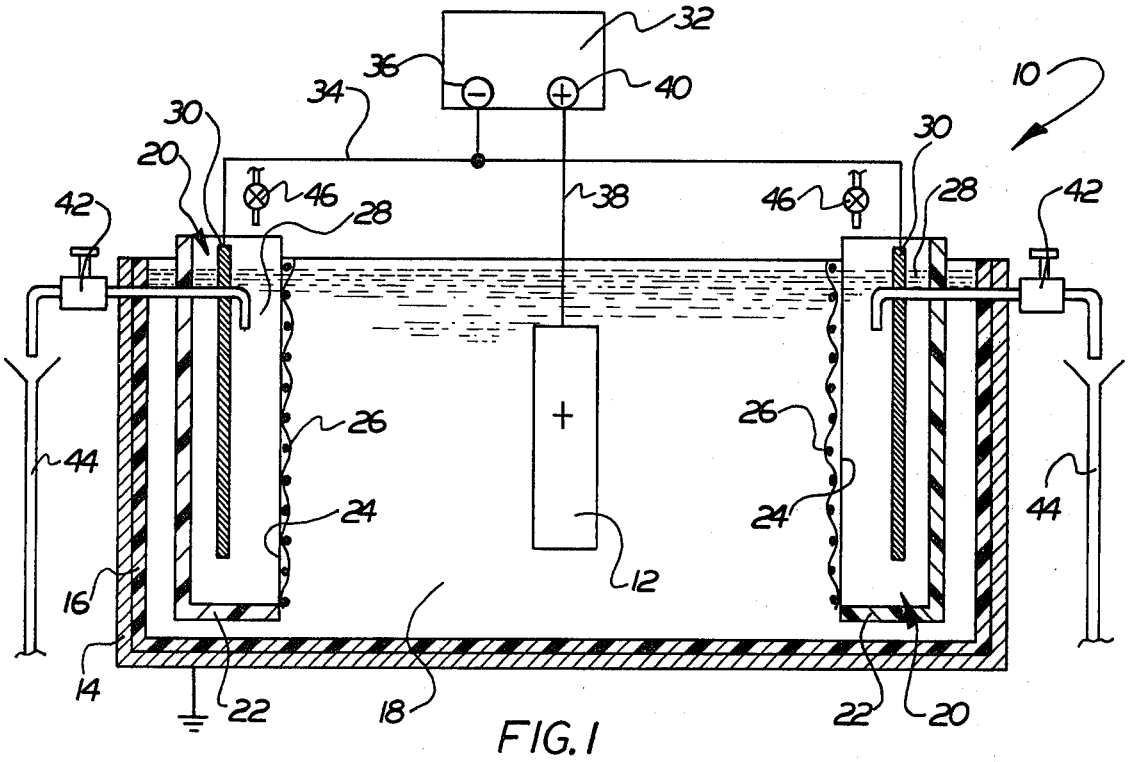
FIG. 1 is a schematic, diagramatic, cross sectional view of an apparatus which may be used in accordance with the process of the present invention.

Referring now to the drawings wherein the showings are for the purpose of illustrating a preferred embodiment of the invention only and not for the purpose of limiting same, FIG. 1 represents one type of cell 10 which may be used to electrophoretically deposit components of a vitreous forging lubricant onto the surface of a titanium workpiece 12. The cell 10 generally comprises a tank 14 preferably having an inert lining 16 on the interior surface thereof.

As used in this specification, the term "titanium workpiece" will be understood to include workpieces made of titanium as well as those made of alloys having titanium as their principal constituent.

The tank 14 is filled with an aqueous coating bath 18 containing forging lubricant precoat components in suspension. In accordance with the invention, the coating bath 18 comprises an aqueous suspension of high lead, low alkali metal oxide, moderate silicate glass frit, the bath 18 having a specific resistivity greater than about 400 ohm-centimeters.

In the preferred embodiment shown in FIG. 1, a pair of cathode compartments 20 are provided. The cathode compartments 20 generally comprise an open-sided box 22 having a dialysis or ion exchange membrane 24 forming one side thereof. A reinforcing mesh 26 may be provided adjacent the membrane 24 to protect the membrane 24 from impact. The cathode compartments 20 are preferably filled with a non-ionic liquid such as de-ionized water 28. An electrophoresis cathode 30 is immersed in the de-ionized water 28 within each of the cathode compartments 20. It will be understood that while a pair of cathode compartments 20 each having a cathode 30 disposed therein is illustrated, other electrophoresis cathode and cathode compartment configurations are possible and are contemplated within the scope of the present invention. Thus, a cylindrical or annular cathode and cathode compartment disposed within the tank 14 could be provided. A plurality of cathodes 30 and cathode compartments 20 may be provided within the tank 14 or alternatively, only a single cathode 30 need be provided.

Although the cathodes are shown disposed within a cathode compartment having a membrane in association therewith, such a configuration is only preferred and it will be understood that the cathodes 30 may be immersed directly in the coating bath 18 without being enclosed in a cathode compartment such as that shown at 20 in FIG. 1. Further, the tank 14 itself may be used as a cathode if no lining 16 is provided to prevent conductive contact of the bath 18 with the walls of the tank 14.

The workpiece 12 is immersed in the coating bath 18 and is positioned centrally between the cathodes 30. A direct current power source 32 is provided and the cathodes are connected through a cathode bus 34 to the negative pole 36 of the power source 32. In a similar manner, the titanium workpiece 12 is connected through an anode bus 38 to the positive pole 40 of the power source 32.

Upon application of a potential difference between the electrophoresis cathodes 30 and the workpiece 12, charged species within the coating bath 18 migrate within the bath. The applied voltage is advantageously within the range of about 10 to 200 volts D.C., 20 to 50 volts D.C. being preferred. Negatively charged species such as negative ions in solution and, more importantly, negatively charged frit particles are transported to and deposited on the workpiece 12. In a similar manner, positive ions, particularly alkali metal ions, in solution in the coating bath 18 migrate through the membrane 24 into the cathode compartments 20. Hydrogen gas is evolved at the cathodes and the alkalinity of the water 28 in the cathode compartments 20 increases. The evolved hydrogen gas may be collected and/or vented as appropriate.

In order to maintain a high resistivity in the water 28 within the cathode compartments 20 and, ultimately, within the entire coating bath 18, a portion of the alkaline solution in the cathode compartments 20 is periodically or continuously withdrawn through taps 42. This withdrawn alkaline solution is conducted into a drain line 44 which may either be directed to waste disposal or, preferably, passed through an ion exchange column in order to regenerate de-ionized water. In order to replace the volume of a solution withdrawn from the cathode compartments 20, taps 46 are provided for adding de-ionized water to the cathode compartments 20. The action of the membrane 24 and cationic transport of alkali metal ions therethrough to the cathode compartments 20 is effective to maintain the specific resistivity of the bath above the desired 400 ohm-centimeter level during the coating deposition process.

As an alternative to the withdrawal of solution from the cathode compartments 20, portions of the coating bath itself may be withdrawn. This withdrawn portion may be passed through an untrafiltration column to remove soluble ions and water. This process also serves to reconcentrate the coating components of the bath 18 which are depleted by the deposition process.

Particulate components of the coating bath 18 are preferably maintained in suspension through the use of agitation. Thus, a mechanical agitator such as a propeller stirrer (not shown) may be provided to agitate the bath 18. It will be understood, however, that other agitation means may be provided. Also, while not being necessary, it is preferred that cooling means be provided in the cell 10 to maintain the temperature of the bath 18 at or near ambient temperature. Since there is some resistance heating of the bath, the maintenance of a constant temperature assists in maintaining the desired high bath resistivity.

The coating bath 18 comprises an aqueous suspension of suspension-size (−200 mesh) glass frit particles and, optionally, a colloidal dispersion of an anodic electrocoating resin. The glass frit composition is chosen so as to comprise a relatively large amount of lead oxide (PbO) and a moderate amount of silica ($SiO_2$). The bath 18 may also include small amounts of alumina ($Al_2O_3$), zinc oxide (ZnO) and/or boron oxide glass ($B_2O_3$). Of primary consideration in the formulation of a glass frit is a low alkali metal oxide content. Thus, the concentration of lithium oxide ($Li_2O$), sodium oxide ($Na_2O$), potassium oxide ($K_2O$), etc., is preferably kept at a combined level of less than about 6% based on the weight of the glass frit composition.

A binder resin is preferably included in the suspension to increase the green strength of the deposited precoat. The resin also assists in the transport and deposition of frit particles. Thus, an anodic resin, that is, a resin which when under the influence of an electric field, is transported thereby to the positive electrode (anode), is chosen. Any of several commercially available anodic electrocoating resins may be used in conjunction with the coating bath. Thus, the anodic resin may be selected from esters of the oleoresinous, epoxy, polyester, or styrene-maleic anhydride types. Other types include styrene-alkyl alcohol esters, maleinized oils, styrene-butadiene, etc. In the preferred embodiment of this invention, an acrylic resin is preferred. During the preheating of a coated workpiece to forging temperatures, the preferred acrylic resins burn off gently with minimum ash or char. Also, many acrylic resins provide adhesive properties for good green strength after only room temperature evaporation of the entrained water without the necessity of a heat cure.

The resins can be either a single component where the resin includes a solubilizer or a solubilizer may be added in order to solubilize the resin in the coating bath.

It will be understood that the inclusion of a resinuous component in the coating bath is only preferred as a means for increasing green strength. Thus, the range of anodic electrocoating resin dispersed in a coating bath may be from 0–400 grams of resin per 1,000 grams of frit. The preferred range of resin in the coating bath for optimum green strength and minimum burn off problems is 200–300 grams of resin per 1,000 grams of frit.

The melted lubricant composition produced by the fusion of the precoat frit at forging temperatures preferably has the following component composition:

TABLE 1

| Composition | Percent Composition Range Based on The Weight Of The Fused Lubricant |
|---|---|
| PbO | 33–73 |
| $SiO_2$ | 20–38 |
| $B_2O_3$ | 0–12 |
| $Al_2O_3$ | 0–9 |
| ZnO | 0–12 |
| Alkaline earth metal oxides | 0–8 |
| Alkali metal oxides | less than 6 |

One preferred frit composition comprises:

TABLE 2

| Composition | Percent Composition Range Based On The Weight Of The Fused Lubricant |
|---|---|
| PbO | 41.2 |
| $SiO_2$ | 29.9 |
| $B_2O_3$ | 8.5 |
| $Al_2O_3$ | 5.8 |
| ZnO | 9.0 |
| CaO | 5.6 |

Other frit compositions may include $V_2O_5$, $ZrO_2$, MgO, etc. in amounts ranging from 0% to 5% each.

While a combination of several different frit compositions may be utilized to achieve a desired lubricant melt composition, it is most convenient in terms of controlling bath composition to utilize only a single frit. This is preferred from a standpoint of simplicity since, although it has been found that deposition of electrophoretic bath components takes place at approximately the same rate, there is a slight differential in the deposition rate of each component which could lead to bath instability and loss of component balance after extended use of the bath. With the use of a single frit system, reconstituting of the bath components is a simple matter of adding additional frit rather than regularly performing a complete analysis of the bath composition to determine what components must be added to achieve a proper balance.

In formulating one preferred deposition bath, approximately 1,000 grams of the particulate frit (−200 mesh) described in Table 2 is suspended in 650 grams of deionized water by ball milling or other mixing processes. Also incorporated in the bath are approximately 300 grams of an amine-solubilized acrylic anodic electrocoating resin as well as a small amount (less than 1%) of a polysaccaride suspension aid and a defoamer. The specific gravity of this formulation is approximately 1.7 g/cc. This is then preferably diluted with deionized water to a specific gravity of about 1.45 g/cc. It will be understood that any particular specific gravity is only preferred. The desired specific gravity being selected upon consideration of such factors as the density of the frit, agitation of the bath, etc. On a volume basis, this formulation results in a bath solids content of about 60% frit and about 40% resin. De-ionized water is used so that the high specific resistivity of the bath is maintained. Ordinary tap water contains alkali and alkaline earth metal ions as well as halide ions which lower the bath resistivity below an acceptable level. With the use of de-ionized water in bath make up, this problem is avoided.

In addition to the deposition reaction, anodization reactions take place at the anodic surface of the titanium workpiece, the anodic reactions being:

$$Ti \rightarrow Ti^{+4} + 4e^-$$

$$2H_2O \rightarrow 4H^+ + 2O^{-2}$$

$$2O^{-2} + Ti^{+4} \rightarrow TiO_2$$

Control of the specific resistivity of the bath is critical to the successful deposition of a coating on the surface of a titanium workpiece. In an ionized solution, titanium workpieces quickly form a passive, high resistance titanium dioxide ($TiO_2$) coating on their surface in accordance with the above reaction sequence. This anodization process quickly limits the simultaneous deposition of coating components resulting in either low or no coating build-up. By providing a coating bath of high resistivity, the simultaneous anodization process can be retarded to a point where an adequate coating thickness may be built up on the surface of the workpiece before anodization limits the deposition. A bath resistivity of about 400 ohm-centimeters represents the useful lower limit for acceptable forging lubricant precoats. At a bath resistivity significantly lower than 400 ohm-centimeters, high voltages are required for adequate coating thickness. Application of high voltages leads to unacceptable coatings having localized ruptures and/or blisters in the deposited coating.

An increase in the applied current causes a corresponding increase in the rate of formation of the $TiO_2$ anodize layer. An increase in the current can result from either an increase in the applied voltage or a decrease in the specific resistivity of the bath.

Anodize layers formed on titanium are dense and have very high electrical resistivity. Because of the high resistivity, only very thin layers, in the range of a few microns, can be formed. Since these layers are dense and $TiO_2$ has a high refractive index, the layers exhibit a complete range of interference colors. This range of interference colors can be easily produced by varying the anodization potential from a few volts to a few hundred volts DC. The interference color observed for a particular set of conditions correlates directly with the thickness of the anodize layer, and thereby, to the electrical resistance of the anodize layer.

The rate of anodization (layer thickness or density build up) depends on the electrical potential applied and on the specific resistivity of the bath. The lower the resistivity of the bath, the faster the anodization reaction proceeds. Titanium anodization is a self-limiting process in that, for a given applied potential, the final anodize layer thickness will be independent of the anodization reaction rate.

Figure 2:
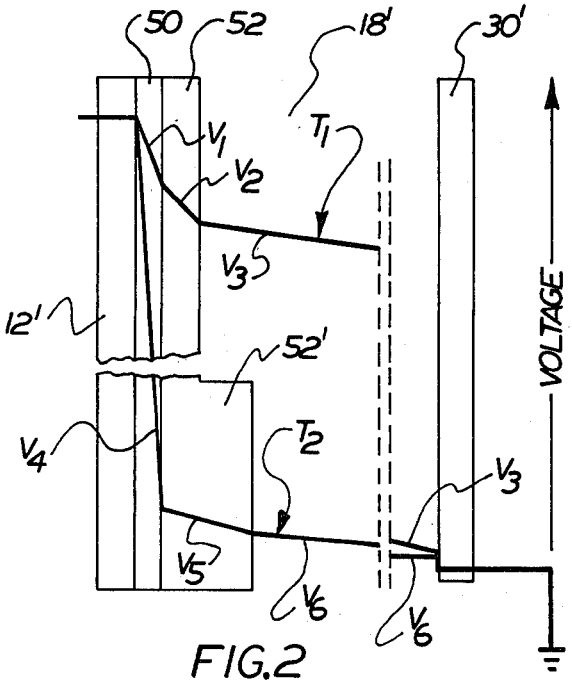
FIG. 2 is a diagramatic representation of a voltage profile for the combined anodic deposition and anodization processes occurring simultaneously on the surface of titanium alloys during the performance of the process of the present invention.

The simultaneous formation of an anodize layer during electrophoretic deposition of a glass lubricant in accordance with this invention has important consequences which are illustrated in FIG. 2.

A titanium workpiece 12' (FIG. 2) is simultaneously coated and anodized upon application of a constant voltage between the workpiece 12' and an electrophoresis cathode 30'. The upper curve $T_1$ represents the voltage profile between the anodic titanium workpiece 12' and the electrophoresis cathode 30' at an early stage of the deposition process. The lower curve $T_2$ represents the voltage profile at or near the end of the deposition process. The thickness of the anodize layer 50 has been greatly exaggerated for the purposes of clarity. At the instant voltage is first applied between a workpiece 12' and the cathode 30', the entire voltage drop is across the coating bath 18'. Quickly, however, an anodize layer 50 starts to form and a lubricant coating 52 begins to deposit by electrophoresis. The voltage profile at this stage is indicated by the voltage curve $T_1$. A small voltage drop $V_1$ appears across the anodize layer 50 and an additional voltage drop $V_2$ appears across the deposited coating 52. The bulk of the voltage drop $V_3$ is still in the bath where the potential difference drives the charged particles, colloids, and ions toward the appropriate electrodes for the deposition process.

Later in the coating process, as represented by the curve $T_2$, most of the voltage drop $V_4$ appears across the anodize layer 50 with a smaller voltage drop $V_5$ appearing across the thicker, built-up coating layer 52'. At this stage, relatively little electrical potential gradient $V_6$ remains across the bath itself to cause migration of the coating components toward the anodic workpiece. Thus, the coating thickness has become "self-limited" despite only a moderate voltage drop across the deposited lubricant layer 52'. This process of self-limiting takes place in the period of time of about 15–30 seconds depending on the applied voltage and the resistivity of the bath.

Since the anodize layer 50 is largely responsible for the self-limiting characteristic observed for the electrophoretic deposition of lubricant on the titanium workpiece 12', it follows that factors which affect the anodization also affect the final thickness of the electrodeposit. If the bath resistivity is low, i.e., the bath containing a large quantity of mobile ions, the titanium will anodize quickly. On the other hand, the effect of bath resistivity on the rate at which the coating components move toward the workpiece is small. Consequently, the self-limiting deposit thickness will decrease as the bath resistivity decreases. By maintaining the specific resistivity of the coating bath 18 above about 400 ohm-centimeters, the anodization rate may be retarded in order to simultaneously build up a sufficient thickness of lubricant coating on the workpiece surface before the self-limiting, high resistance feature of the anodize layer effectively ends the deposition process.

As discussed previously, the thickness of the anodize layer determines the rate of coating deposition at any given applied potential. Thus, if a titanium workpiece is preanodized in whole or in part prior to electrophoretic deposition, a thinner deposit will result on the preanodized portion of the workpiece. The thickness of the anodize layer formed in an operation prior to electrophoretic coating can be easily and accurately judged by the interference color produced on the surface of the workpiece. A very thin anodize layer is light amber in color. Through experimentation, it has been determined that the coating thickness is reduced by approximately 10% if the workpiece is preanodized to a point where this light amber color is formed. In a similar manner, an anodize layer of sky blue color will completely prevent deposition of a coating. Intermediate these extremes, the thickness of the lubricant deposit can be varied over a wide range at any selected portion of the titanium workpiece by selectively preanodizing that region to the desired interference color.

A number of techniques for selective anodization are possible. An electrolyte of sodium bicarbonate and deionized water has been found convenient, although it will be understood that any ionic solution may be utilized. In a preferred embodiment, the anodizing electrolyte has a specific resistivity of 100 ohm-centimeters or less. Using this electrolyte, applied potentials of 5–40 volts DC produce easily controlled anodization and development of the desired interference colors.

One method of selectively preanodizing only a portion of a workpiece is to mask off the area where anodization is not desired, i.e., masking areas where thicker coats are desired. A diffuse blend from anodized to unanodized areas is achieved by undercutting the mask at an angle. A hot dip coating of cellulose acetate-butyrate provides an effective mask which can be easily cut away in the appropriate areas to be anodized.

A second technique for preanodizing a workpiece comprises dipping the workpiece into the anodizing electrolyte and withdrawing the portions of the workpiece on which lesser anodize layers (greater lubricant coating thickness) are desired. This technique is of limited use in that intermediate portions of the workpiece cannot be preanodized to a greater degree than at least one outside portion.

Another technique utilizes contoured cathodes which are differentially spaced from the workpiece, closer spacing being provided in the areas where greater preanodization is desired.

In a preferred technique, a wand-form cathode may be used by hand holding the cathode near the anodic workpiece which is immersed in the anodizing electrolyte. By moving the cathode adjacent the surface of the workpiece, the anodize layer may be "painted" onto the desired locations of the workpiece. The cathode is preferably partially encased in a dielectric material to prevent shorting and to control spacing between the cathode and the anodic workpiece. Electrolyte may also be pumped through a tube surrounding the cathode in order to provide an agitation function to remove evolved gases from the electrodes. Using this method, almost any spatial distribution of preanodized portions of the workpiece may be obtained.

In a manner similar to the hand held wand-form cathode, a felt pad which has been saturated with electrolyte may be connected as a cathode with the workpiece being anodically connected. By rubbing the electrolyte-saturated felt over the surface of the workpiece, rapid anodization of the workpiece in the areas in contact with the felt occurs. The technique may be closely controlled as evidenced by its use by some artists to "paint" on a titanium sheet. This artistic use of the process results in a detail accuracy and color range approximating that of water-color painting.

In carrying out the electrophoretic coating of a titanium workpiece, a clean surface is preferably provided by etching the workpiece in a mixture of nitric and hydrofluoric acids. Optionally, the acid etch may be accelerated by the application of anodic current to the workpiece with a graphite counter-electrode. Following cleansing of the surface, any desired preanodization in accordance with any of the above techniques may be effected. The workpiece is then immersed in the coating bath and an electrical potential is applied between the anodic workpiece and an electrophoresis cathode. An anodize layer and lubricant coating are simultaneously developed on the surface of the workpiece to the point of self-limitation at which time the coating thickness is generally in the range of 0–5 mils depending on the degree of preanodization.

The workpiece is then removed from the bath and preferably rinsed with de-ionized water to recover bath drag out. The coating may then be air dried or cured at an elevated temperature at which point the "green," coated workpiece is ready for forging or storage prior to forging. Drag out may be recovered and recycled to the deposition bath by ultrafiltration.

If a clean surface is not provided on the workpiece, residue such as fingerprints, oil or other surface defects such as forging laps, cracks, crevices, compositional inhomogeneities, etc., may effectively limit or retard the anodization rate both in the preanodizing step and in the coating step. Because anodization is further retarded in these defective areas, coating thickness in these areas is developed to a greater degree. Thus, the electrophoretic coating process of the present invention provides an additional advantage of acting as a defect detection means. By visually inspecting the coating following the electrodeposition process, defective workpieces may be detected and eliminated since areas in which a defect is present are clearly indicated by a noticeably thicker coating buildup.

The build-up of thicker coatings where a surface defect occurs may also be used to advantage to provide a greater coating thickness on selected areas. Thus, rubbing a material such as graphite on a portion of the surface of the workpiece changes that portion of the surface of the workpiece thereby coating to retard or eliminate anodization in those surface portions. Thus, a thicker coating layer is deposited on such portions.

From the foregoing it is apparent that the present invention provides a forging lubricant coating bath and a process which overcomes prior difficulties in electrophoretically depositing a lubricant coating onto the surface of a titanium workpiece. The production of an anodize layer on the surface of a titanium workpiece has been shown to be of advantage to control the thickness of an electrophoretically deposited coating from a properly controlled bath and by the process of this invention. The process has also been shown to be advantageous in detecting defects in the titanium workpiece.

In accordance with the invention, the titanium workpiece 12 is precoated with components of a vitreous forging lubricant by immersing the workpiece in an electrophoretic coating bath 18 having a specific resistivity in excess of about 400 ohm-centimeters. The coating bath 18 generally comprises a suspension of particulate forging lubricant components and, optionally, may include an organic resin in colloidal dispersion in the bath. The titanium workpiece 12 is connected as an anode and an electrophoresis cathode 30 is provided in contact with the coating bath 18. Upon application of direct current, forging lubricant components are deposited on the surface of the workpiece 12.

The thickness of the coating applied through the aforementioned process may be controlled by at least partially preanodizing portions of the surface of the titanium workpiece 12 in an anodizing electrolyte prior to immersion in the coating bath 18. The thickness of the electrophoretically deposited coating is inversely proportional to the degree of preanodization. That is, the greater the degree of preanodization, the thinner will be the resultant coating when an electrophoretic deposit is applied.

While the invention has been described in the more limited aspects of a preferred embodiment thereof, other embodiments have been suggested and still others will occur to those skilled in the art upon a reading and understanding of the foregoing specification. It is intended that all such embodiments be included within the scope of the invention as limited only by the appended claims.

Having thus described my invention, I claim:

1. An electrophoretic process for coating a titanium workpiece with a forging lubricant precoat comprising the steps of:

providing an electrophoretic coating bath having components of a particulate forging lubricant precoat suspended therein, said components, by dry lubricant coating weight, consisting essentially of 33%–73% PbO; 20%–38% $SiO_2$; 0%–12% $B_2O_3$; 0%–8% $ZrO_2$ and alkaline earth metal oxides, and less than 6% alkali metal oxides;

providing at least one electrophoresis cathode in contact with the bath;

immersing the titanium workpiece in the coating bath, and applying anodic potential to the titanium workpiece while applying cathodic potential to the electrophoresis cathode to electrophoretically deposit a forging lubricant precoat on the workpiece while controlling the rate of anodization of the workpiece by maintaining a specific resistivity of the bath at a level in excess of about 400 ohm-centimeters.

2. The process as set forth in claim 1 further including the step of providing an anodic electrocoating resin in the coating bath.

3. The process as set forth in claim 1 further including removing cations from the coating bath.

4. The process as set forth in claim 4 wherein said step of removing is carried on continuously throughout the process.

5. The process as set forth in claim 1 further including the step of at least partially preanodizing the workpiece prior to the step of immersing.

6. The process as set forth in claim 5 wherein said step of partially preanodizing is applied to only selected areas of the workpiece.

7. The process as set forth in claim 1 further including the step of etching the workpiece prior to the step of immersing.

8. A process for controlling the thickness of an electrophoretically deposited forging lubricant precoat on a titanium workpiece comprising the steps of contacting at least a portion of a workpiece with an aqueous anodizing electrolyte having a low specific resistivity;

electrically connecting the workpiece to a source of anodic potential;

applying cathodic potential to a cathode in contact with the anodizing electrolyte to at least partially preanodize the portion of the workpiece adjacent the counterelectrode;

removing the at least partially preanodized workpiece from the anodizing electrolyte and immersing the at least partially preanodized workpiece in an aqueous suspension of particulate forging lubricant, the suspension having a specific resistivity in excess of about 400 ohm-centimeters, and applying anodic potential to the at least partially pre-anodized workpiece while applying cathodic potential to an electrophoresis cathode in contact with the aqueous suspension to electrophoretically deposit a forging lubricant precoat onto the at least partially pre-anodized workpiece.

9. The process as set forth in claim 8 wherein said step of contacting includes at least partially immersing the workpiece in the electrolyte.

10. The process as set forth in claim 9 further including masking portions of the workpiece to limit preanodization of the masked portions.

11. The process as set forth in claim 8 wherein said step of contacting includes absorbing a quantity of the electrolyte onto an absorbent pad, the pad being in electrical contact with both the cathode and the workpiece.

12. A bath for electrophoretically precoating a titanium workpiece with a forging lubricant comprising a high lead, low alkali metal oxide ceramic frit suspended in an aqueous carrier, said bath having a specific resistivity in excess of about 400 ohm-centimeters, and wherein said frit in percent by weight, consists essentially of:

33%–73% PbO
20%–38% $SiO_2$
0%–12% $B_2O_3$
0%–12% ZnO
0%–9% $Al_2O_3$
0%–8% $ZrO_2$/alkaline earth metal oxide
less than 6% alkali metal oxides.

13. The bath as set forth in claim 12 further including an anodic electrocoating resin in solution with said carrier.

14. The bath as set forth in claim 13 wherein said anodic electrocoating resin is selected from a group consisting of: oleoresinous, epoxy, polyester, and styrene-maleic anhydride esters; styrene-alkyl alcohol esters; maleinized oils; styrene-butadiene, and acrylic resins.

15. The bath as set forth in claim 14, wherein said anodic electrocoating resin is an acrylic resin.

16. The bath as set forth in claim 15, wherein said acrylic resin is an amine-solubilized acrylic resin.

17. The bath as set forth in claim 16 including 200–300 parts by weight of said amine-solubilized acrylic resin.

18. The bath as set forth in claim 17 wherein said frit has the following compositions in percent by weight:

41.2% PbO
29.9% $SiO_2$
9.0% ZnO
8.5% $B_2O_3$
5.8% $Al_2O_3$
5.6% CaO.

19. A process for detecting defects in a titanium workpiece comprising the steps of providing an electrophoretic coating bath having components of a particulate forging lubricant precoat suspended therein, said components, by dry lubricant coating weight, consisting essentially of 33%–73% PbO; 20%–38% $SiO_2$; 0%–12% $B_2O_3$; 0%–8% $ZrO_2$ and alkaline earth metal oxides, and less than 6% alkali metal oxides, providing at least one electrophoresis cathode in contact with the bath, immersing the titanium workpiece in the coating bath, applying anodic potential to the titanium workpiece while applying cathodic potential to the electrophoresis cathode to electrophoretically deposit a forging lubricant precoat on the workpiece while controlling the rate of anodization of the workpiece by maintaining a specific resistivity of the bath at a level in excess of about 400 ohm-centimeters, and visually inspecting the forging lubricant precoat for areas of greater coating thickness.

* * * * *